US008292455B2

(12) United States Patent
Koizumi

(10) Patent No.: US 8,292,455 B2
(45) Date of Patent: Oct. 23, 2012

(54) VEHICULAR LAMP

(75) Inventor: Hiroya Koizumi, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 352 days.

(21) Appl. No.: 12/638,609

(22) Filed: Dec. 15, 2009

(65) Prior Publication Data

US 2010/0149828 A1 Jun. 17, 2010

(30) Foreign Application Priority Data

Dec. 15, 2008 (JP) ..... 2008-318821

(51) Int. Cl.
*F21V 1/00* (2006.01)

(52) U.S. Cl. ..... 362/217.02; 362/517; 362/522

(58) Field of Classification Search ..... 362/509, 362/516–522, 543–547, 217.02, 217.05, 362/225, 236, 237, 240, 268, 311.01, 311.02, 362/327, 351

See application file for complete search history.

(56) References Cited

U.S. PATENT DOCUMENTS 2,356,654 A * 8/1944 Cullman ..... 362/223
5,813,743 A * 9/1998 Naka ..... 362/16
6,814,470 B2 * 11/2004 Rizkin et al. ..... 362/327
6,827,467 B2 * 12/2004 Tenmyo ..... 362/268
6,902,291 B2 * 6/2005 Rizkin et al. ..... 362/153.1
6,940,660 B2 * 9/2005 Blümel ..... 359/726
2005/0117318 A1 * 6/2005 Tenmyo ..... 362/16
2009/0161360 A1 * 6/2009 Li et al. ..... 362/235

FOREIGN PATENT DOCUMENTS

JP 2004-103503 A 4/2004

OTHER PUBLICATIONS

English Patent Abstract of JP2004103503 from esp@cenet, published Apr. 2, 2004, 1 page.

* cited by examiner

*Primary Examiner* — Julie Shallenberger
(74) *Attorney, Agent, or Firm* — Osha Liang LLP

(57) ABSTRACT

A vehicular lamp including, in a lamp chamber formed by a lamp body having a front opening and a transparent front cover attached to the front opening, a semiconductor light-emitting element; and an inner lens positioned forward of the semiconductor light-emitting element. The inner lens includes a first light control portion for diffusing light from the semiconductor light-emitting element in a horizontal direction; and second light control portions respectively positioned on left and right sides of the first light control portion, each of which have a reflective surface for reflecting the light from the semiconductor light-emitting element in a predetermined direction.

20 Claims, 2 Drawing Sheets

VEHICULAR LAMP

BACKGROUND OF INVENTION

1. Field of the Invention

The present invention relates to vehicular lamps, and more particularly, to vehicular lamps used as back lamps for vehicles.

2. Related Art

Conventionally, vehicular back lamps using an LED (light-emitting diode) as a light source are known in the art (see, e.g., Patent Document 1).

[Patent Document 1] Japanese Patent Application Laid-Open (Kokai) No. JP-A-2004-103503

SUMMARY OF INVENTION

Back lamps for vehicles are legally required to have a horizontally wide light distribution pattern. In the case of optical systems using an LED and an inner lens, the use of an LED having a weak orientation characteristic can achieve a horizontally wide light distribution pattern, but, in this case, light utilization efficiency is reduced. On the other hand, the use of an LED having a strong orientation characteristic can improve the light utilization efficiency, because light outputted from the LED can be refracted to a desired direction by an inner lens with no loss. In this case, however, it is difficult to achieve a wide light distribution pattern.

One or more embodiments of the present invention provide a vehicular lamp capable of improving light utilization efficiency while achieving a horizontally wide light distribution pattern.

In one or more embodiments, a vehicular lamp includes, in a lamp chamber formed by a lamp body having a front opening and a transparent front cover attached to the front opening, a semiconductor light-emitting element and an inner lens positioned forward of the semiconductor light-emitting element. In the vehicular lamp, the inner lens includes a first light control portion for diffusing light from the semiconductor light-emitting element in a horizontal direction, and second light control portions respectively positioned on left and right sides of the first light control portion, each of which has a reflective surface for reflecting the light from the semiconductor light-emitting element in a predetermined direction.

According to this aspect, because the light from the semiconductor light-emitting element is diffused in the horizontal direction by the first light control portion of the inner lens, a horizontally wide light distribution pattern can be achieved. Moreover, because the second light control portions, each having a reflective surface, are respectively provided on the left and right sides of the first light control portions, light having a large radiation angle, out of light emitted from the semiconductor light-emitting element, is reflected by the reflective surfaces of the second control portions, and contributes to formation of a light distribution pattern. This reduces loss of the emitted light from the semiconductor light-emitting element, whereby the light utilization efficiency can be improved.

The inner lens may further include third light control portions respectively positioned on upper and lower sides of the first light control portion, each of which has a reflective surface for reflecting the light from the semiconductor light-emitting element in a predetermined direction. By positioning the reflective surfaces not only on the left and right sides of the first light control portion, but also, on the upper and lower sides of the first light control portion in this manner, the loss of the emitted light from the semiconductor light-emitting element is further reduced, whereby the light utilization efficiency can be further improved.

The first light control portion and the second light control portions may further diffuse the light from the semiconductor light-emitting element in a vertical direction, and the reflective surface of the third light control portion positioned on the upper side of the first light control portion, and the reflective surface of the third light control portion positioned on the lower side of the first light control portion may have different shapes from each other. Thus, by further diffusing the light from the semiconductor light-emitting element in the vertical direction, wide light distribution performance in the vertical direction can also be obtained. Moreover, because the reflective surfaces on the upper and lower sides of the first light control portion have different shapes from each other, different light distribution patterns can be formed in the vertical direction, whereby various light distribution patterns can be achieved.

The semiconductor light-emitting element may be mounted on a power supply member, and the power supply member may be mounted on a heat sink for dissipating heat generated from the semiconductor light-emitting element. In this case, because the heat from the semiconductor light-emitting element is dissipated by the heat sink in a preferable manner, reduction in light emission efficiency of the semiconductor light-emitting element can be suppressed.

The inner lens may include a positioning portion for positioning the power supply member and/or the heat sink. In this case, the position accuracy between the inner lens and the power supply member and/or the heat sink can be improved. With the improvement in position accuracy, light from the semiconductor light-emitting element mounted on the power supply member is appropriately incident on the inner lens, whereby the light distribution performance can be improved.

A vehicular lamp, which is capable of improving the light utilization efficiency while achieving a horizontally wide light distribution pattern, can be provided according to one or more embodiments of the present invention.

Other aspects and advantages of the invention will be apparent from the following description, the drawings and the claims.

DETAILED DESCRIPTION

Figure 1:
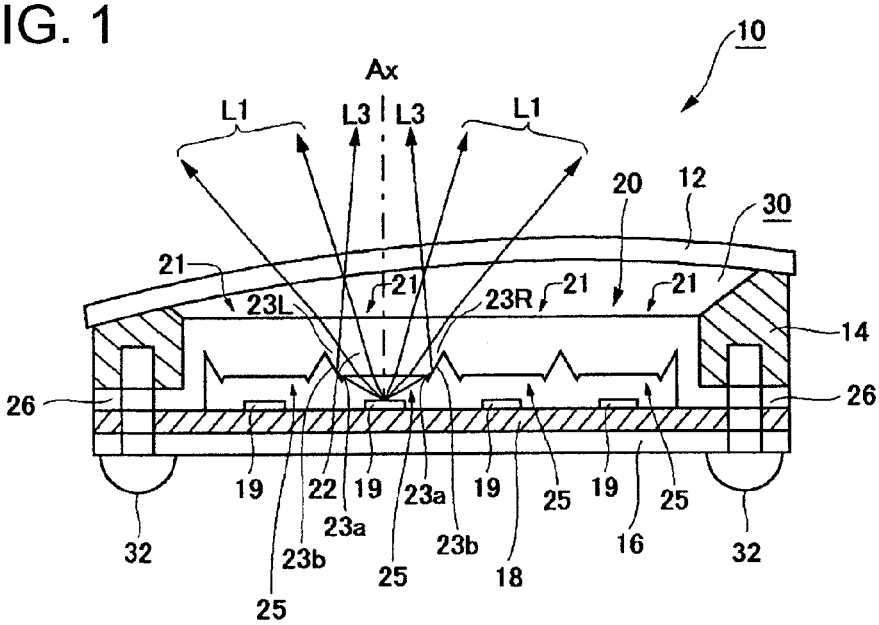
FIG. 1 is a horizontal cross-sectional view of a vehicular lamp according to an embodiment of the present invention.
Figure 2:
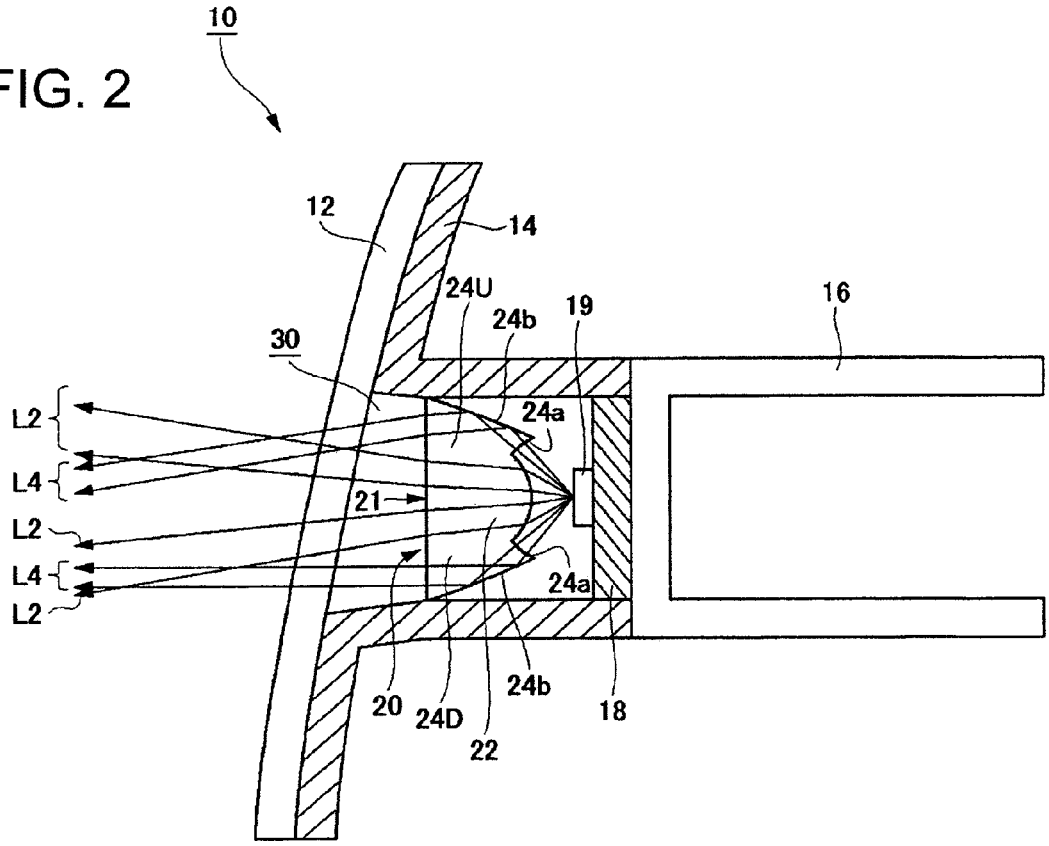
FIG. 2 is a vertical cross-sectional view of the vehicular lamp according to the embodiment of the present invention shown in FIG. 1.

Hereafter, embodiments of the present invention will be described in detail with reference to accompanying drawings. FIG. 1 is a horizontal cross-sectional view of a vehicular lamp 10 according to one or more embodiments of the present invention. FIG. 2 is a vertical cross-sectional view of the vehicular lamp 10.

The vehicular lamp 10 is used as a back lamp that is provided in a vehicle. The vehicular lamp 10 includes four LEDs 19 and an inner lens 20 positioned forward of the four LEDs 19 in a lamp chamber 30 formed by a lamp body 14 having a front opening and a rear opening, and a transparent front cover 12 attached to the front opening.

As shown in FIG. 1, the four LEDs 19 are positioned adjacent to each other at equal intervals in a lateral direction on a substrate 18 as a power supply member. Moreover, the inner lens 20 is formed by four element lenses 21 arranged adjacent to each other in the lateral direction. The LEDs 19 and the element lenses 21 respectively correspond to each other, thereby forming four light-emitting units 25. Because the four light-emitting units 25 have substantially the same structures, the second light-emitting unit 25 from the left in FIG. 1 will be described as an example in this specification.

The LED 19 is provided so that a light emitting direction thereof faces an optical axis Ax direction of the light emitting unit 25. Power is supplied to the LED 19 through an interconnect pattern formed in the substrate 18. The substrate 18 is made of a high thermal conductivity material such as ceramic.

The substrate 18 is mounted on a heat sink 16 for dissipating heat generated by the LED 19. The heat sink 16 is made of a high thermal conductivity metal, e.g., aluminum. In the embodiment shown, the heat sink 16 is bent to have a U-shaped vertical cross section, as shown in FIG. 2. Bending the heat sink 16 in this manner enables a more compact structure of the vehicular lamp 10 as compared to the case where a heat sink is formed simply by a flat plate. Heat generated by the LED 19 is transmitted to the heat sink 16 via the substrate 18, and is dissipated from the heat sink 16. That is, the LED 19 is thermally connected to the heat sink 16.

The inner lens 20 has, at both ends in the lateral direction, a positioning portion for positioning the substrate 18 and the heat sink 16. Each positioning portion has a through hole, so that the inner lens 20, the substrate 18, and the heat sink 16 can be fixed to the lamp body 14 by aligning this through hole with respective through holes provided in the substrate 18 and the heat sink 16, and fastening the inner lens 20, the substrate 18, and the heat sink 16 together using a bolt 32. Providing the positioning portions 26 in the inner lens 20 in this manner can improve the attachment position accuracy between the inner lens 20, the substrate 18, and the heat sink 16. With the improvement in attachment position accuracy, light from the LEDs 19 mounted on the substrate 18 is appropriately incident on the respective element lenses 21 of the inner lens 20, whereby the light distribution performance can be improved. Moreover, because assembly is facilitated, the manufacturing cost can be reduced.

As shown in FIGS. 1 and 2, the inner lens 20 includes a first light control portion 22 positioned in front of each LED 19, second light control portions 23L, 23R positioned on the left and right sides of the first light control portion 22, and third light control portions 24U, 24D positioned on the upper and lower sides of the first light control portion 22.

The first light control portion 22 is shaped like a cylindrical lens extending in the lateral direction, and incident and reflective surfaces of the first light control portion 22 extend perpendicularly to an optical axis Ax. A curved surface of the first light control portion 22 serves as the incident surface and faces the LED 19, and a flat surface of the first light control portion 22 serves as an emitting surface and faces the front cover 12. As shown by light beams L1 in FIG. 1, the first light control portion 22 diffuses light from the LED 19 in a horizontal direction. Moreover, the first light control portion 22 diffuses the light from the LED 19 also in a vertical direction (light beams L2 in FIG. 2). The light emitted from the first light control portion 22 is emitted to the outside through the front cover 12.

Each of the second light control portions 23L, 23R includes an incident surface 23*a* for receiving light from the LED 19, and a reflective surface 23*b* for reflecting the light, which has entered the second light control portion 23 through the incident surface 23*a*, to the front of the lamp toward the optical axis Ax. The incident surfaces 23*a* are respectively formed by small protruding portions, which are formed on both left and right ends of the incident surface of the first light control portion 22 so as to protrude toward the back of the vehicular lamp 10. Each of the reflective surfaces 23*b* is formed by a groove formed between adjoining ones of the element lenses 21. The reflective surfaces 23*b* may be formed by depositing aluminum or the like on the respective surfaces of the grooves, or may be formed by adjusting a tilt angle of the reflective surfaces 23*b* so that an incident angle of light that is incident on the reflective surfaces 23*b* becomes a total reflection angle or more. In the embodiment shown, the reflective surfaces 23*b* are formed by a part of a paraboloid of revolution about the optical axis Ax.

Of the light emitted from the LED 19 in the lateral direction, light having a large radiation angle is incident on the incident surfaces 23*a* of the second light control portions 23L, 23R. The light incident on the incident surfaces 23*a* is reflected to the front of the lamp by the reflective surfaces 23*b*. Because the reflective surfaces 23*b* of the second light control portions 23L, 23R are formed by a part of a paraboloid of revolution about the optical axis Ax, the light reflected from the reflective surfaces 23*b* is emitted so as to be collected on a focal point on the optical axis Ax, as shown by light beams L3 in FIG. 1.

Each of the third light control portions 24U, 24D has an incident surface 24*a* for receiving light from the LED 19, and a reflective surface 24*b* for reflecting the light, which has entered the third light control portion 24 through the incident surface 24*a*, to the front of the lamp. The incident surfaces 24*a* and the reflective surfaces 24*b* are respectively formed by protruding portions, which are formed on both upper and lower ends of the incident surface of the first light control portion 22 so as to protrude toward the back of the vehicular lamp 10. The reflective surfaces 24*b* may be formed by depositing aluminum or the like on the outer surfaces of the protruding portions, or may be formed by adjusting a tilt angle of the reflective surfaces 24*b* so that an incident angle of light that is incident on the reflective surfaces 24*b* becomes a total reflection angle or more. The third light control portions 24U, 24D are formed so as to extend in the lateral direction along the first light control portion 22.

Of the light emitted from the LED 19 in the vertical direction, light having a large radiation angle is incident on the incident surfaces 24*a* of the third light control portions 24U, 24D, as shown by light beams L4 in FIG. 2. The light incident on the incident surfaces 24*a* is reflected to the front of the lamp by the reflective surfaces 24*b*.

The reflective surface of the third light control portion 24U on the upper side of the first light control portion 22, and the reflective surface of the third light control portion 24D on the lower side of the first light control portion 22 have different shapes from each other. Making the shapes of the reflective surfaces 24*b* different from each other between the third light control portion 24U and the third light control portion 24D in this manner enables the third light control portion 24U and the third light control portion 24D to form different light distribution patterns from each other, whereby various light distribution patterns can be achieved. In the embodiment shown, the upper third light control portion 24U is formed to have a curved shape in vertical cross section, and the lower third light control portion 24D is formed to have a linear shape in vertical cross section. Thus, the light reflected by the reflective surface 24*b* of the upper third light control portion 24U is emitted to the front of the lamp without being diffused so widely, and the light reflected by the reflective surface 24*b* of the lower third light control portion is widely diffused and emitted to the front of the lamp, because the emitting angle varies depending on the incident position on the reflective surface 24*b*.

Figure 3:
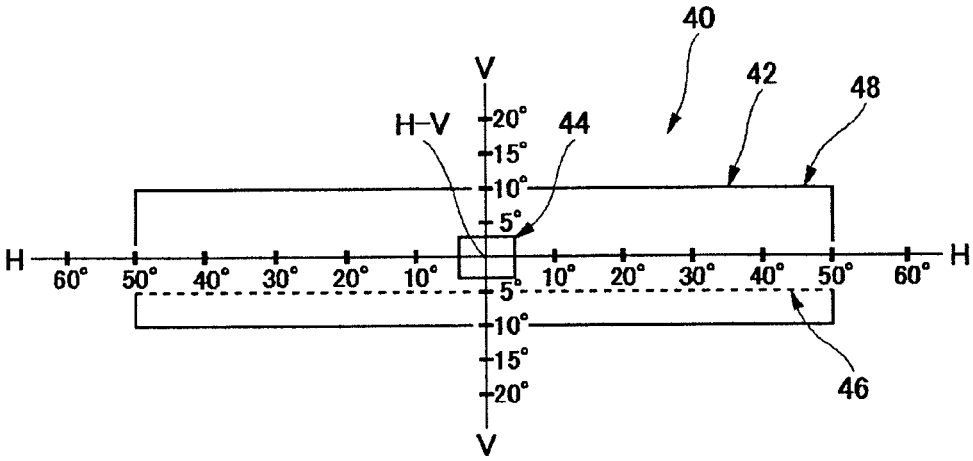
FIG. 3 is a diagram illustrating a light distribution pattern formed by the vehicular lamp according to the embodiment of the present invention shown in FIGS. 1 and 2.

FIG. 3 is a diagram illustrating a light distribution pattern formed by the vehicular lamp 10 according to the embodiment of the present invention shown in FIGS. 1 and 2. FIG. 3 shows a light distribution pattern 40 formed on a virtual vertical screen positioned √10 m behind the vehicle by light radiated from the vehicular lamp 10.

As shown in FIG. 3, the light distribution pattern 40 includes: a first light distribution pattern 42 that is formed in a generally horizontally oblong shape and formed in a region of 10° in each of the upward and downward directions and 50° in each of the leftward and rightward directions; a second light distribution pattern 44 formed in a region around a point H-V (an intersection of lines H-H and V-V); a third light distribution pattern 46 that is formed in a generally horizontally oblong shape and in a region of 0° to 5° in the downward direction and 50° in each of the leftward and rightward directions; and a fourth light distribution pattern 48 that is formed in a generally horizontally oblong shape and formed in a region of 10° in each of the upward and downward directions and 50° in each of the leftward and rightward directions.

The first light distribution pattern 42 is formed by light refracted by the first light control portion 22 and diffused in the horizontal and vertical directions after being emitted from the LED 19. The second light distribution pattern 44 is formed by light reflected by the second light control portions 23L, 23R and collected after being emitted from the LED 19. The third light distribution pattern 46 is formed by light reflected by the upper third light control portion 24U after being emitted from the LED 19. The fourth light distribution pattern 48 is formed by light reflected by the lower third light control portion 24D after being emitted from the LED 19.

Back lamps for vehicles are legally required to have a horizontally wide light distribution pattern. The back lamps are also required to have a light distribution pattern having high brightness around the point H-V. According to the vehicular lamp 10, because light is diffused in the horizontal direction by the first light control portion 22, a horizontally wide light distribution pattern can be formed.

Moreover, the second light distribution pattern 44 having high brightness around the point H-V can be formed by the second light control portions 23L, 23R provided on the left and right sides of the first light control portion 22. Light reflected by the second light control portions 23L, 23R is light having a large radiation angle, out of the light emitted from the LED 19. Such light corresponds to the light that cannot be made to contribute to formation of a light distribution pattern in a preferable manner and, thus, becomes a loss in a conventional vehicular lamp such as that shown in Patent Document 1 described above. The vehicular lamp 10 enables this light, which becomes a loss in the conventional example, to contribute to formation of a light distribution pattern, whereby the light utilization efficiency can be improved.

Moreover, the third light distribution pattern 46 and the fourth light distribution pattern 48 can be formed by the third light control portions 24U, 24D provided on the upper and lower sides of the first light control portion 22. Thus, a wide light distribution pattern having high brightness along the line H-H can be achieved. Light reflected by the third light control portions 24U, 24D also corresponds to the light that cannot be made to contribute to formation of a light distribution pattern in a preferable manner and, thus, becomes a loss in the conventional example. The vehicular lamp 10 enables this light, which becomes a loss in the conventional example, to contribute to formation of a light distribution pattern, whereby the light utilization efficiency can be further improved.

Moreover, because the vehicular lamp 10 is structured to use a plurality of light control portions according to a required light distribution, optical functions, such as reflection and refraction, which are required for each light control portion, are simple. Thus, the thickness of the inner lens 20 can be reduced. This can improve the dimensional accuracy in formation of the inner lens 20, and can also reduce the weight of the vehicular lamp 10.

The present invention has been described above based on exemplary embodiments. It is to be understood by those skilled in the art that these embodiments are shown by way of example only, and various modifications can be made to combinations of the components and the processing processes, and such modifications also fall within the scope of the present invention.

For example, the LED is used as the light source in the above embodiments.

However, a semiconductor light-emitting element, such as a semiconductor laser, may be used.

Moreover, the four light-emitting units are arranged adjacent to each other in the above embodiments. However, the number of light-emitting units 25, how the light-emitting units 25 are arranged, and the like are not specifically limited.

Moreover, the above embodiments have been described with respect to the case where the vehicular lamp is used as a backup lamp. However, the vehicular lamp may also be applied to a daytime running lamp, a fog lamp, and the like.

While description has been made in connection with exemplary embodiments of the present invention, it will be obvious to those skilled in the art that various changes and modification may be made therein without departing from the present invention. It is aimed, therefore, to cover in the appended claims all such changes and modifications falling within the true spirit and scope of the present invention.

[Description Of The Reference Numerals]

10 VEHICULAR LAMP
12 FRONT COVER
14 LAMP BODY
16 HEAT SINK
18 SUBSTRATE
19 LED
20 INNER LENS
22 FIRST LIGHT CONTROL PORTION
23L, 23R SECOND LIGHT CONTROL PORTION
24U, 24D THIRD LIGHT CONTROL PORTION
30 LAMP CHAMBER

What is claimed is:

1. A vehicular lamp comprising:

a lamp chamber formed by a lamp body having a front opening and a transparent front cover attached to the front opening, a semiconductor light-emitting element in the lamp chamber; and an inner lens in the lamp chamber positioned forward of the semiconductor light-emitting element, wherein the inner lens comprises:

a first light control portion that is a cylindrical lens extending in a horizontal direction for diffusing light from the semiconductor light-emitting element in the horizontal direction; and second light control portions respectively positioned on left and right sides of the first light control portion, each of which have a reflective surface for reflecting the light from the semiconductor light-emitting element in a predetermined direction, wherein the predetermined direction is directed towards the optical axis.

2. The vehicular lamp according to claim 1, wherein the inner lens further comprises third light control portions respectively positioned on upper and lower sides of the first light control portion, each of which has a reflective surface for reflecting the light from the semiconductor light-emitting element in a predetermined direction.

3. The vehicular lamp according to claim 2, wherein the first light control portion and the second light control portions further diffuse the light from the semiconductor light-emitting element in a vertical direction, and wherein the reflective surface of the third light control portion positioned on the upper side of the first light control portion, and the reflective surface of the third light control portion positioned on the lower side of the first light control portion have different shapes from each other.

4. The vehicular lamp according to claim 1, wherein the semiconductor light-emitting element is mounted on a power supply member, and the power supply member is mounted on a heat sink for dissipating heat generated from the semiconductor light-emitting element.

5. The vehicular lamp according to claim 4, wherein the inner lens includes a positioning portion for positioning the power supply member and/or the heat sink.

6. The vehicular lamp according to claim 2, wherein the semiconductor light-emitting element is mounted on a power supply member, and the power supply member is mounted on a heat sink for dissipating heat generated from the semiconductor light-emitting element.

7. The vehicular lamp according to claim 3, wherein the semiconductor light-emitting element is mounted on a power supply member, and the power supply member is mounted on a heat sink for dissipating heat generated from the semiconductor light-emitting element.

8. The vehicular lamp according to claim 6, wherein the inner lens includes a positioning portion for positioning the power supply member or the heat sink.

9. The vehicular lamp according to claim 7, wherein the inner lens includes a positioning portion for positioning the power supply member and/or the heat sink.

10. The vehicular lamp according to claim 4, wherein the heatsink has a U-shaped vertical cross section.

11. The vehicular lamp according to claim 1 further comprising:

a plurality of the semiconductor light-emitting element positioned adjacent to each other at equal intervals; and a plurality of the inner lens arranged adjacent to each other in the lateral direction so as to respectively correspond to each of the plurality of semiconductor light-emitting elements.

12. The vehicular lamp according to claim 11, wherein the plurality of inner lenses are formed to be one-piece component.

13. A method of manufacturing a vehicular lamp comprising:

disposing, in a lamp chamber formed by a lamp body having a front opening and a transparent front cover attached to the front opening, a semiconductor light-emitting element; and positioning an inner lens forward of the semiconductor light-emitting element, wherein the inner lens comprises:

a first light control portion that is a cylindrical lens extending in a horizontal direction for diffusing light from the semiconductor light-emitting element in the horizontal direction; and second light control portions respectively positioned on left and right sides of the first light control portion, each of which have a reflective surface for reflecting the light from the semiconductor light-emitting element in a predetermined direction, wherein the predetermined direction is directed towards the optical axis.

14. The method according to claim 13, wherein the inner lens further comprises third light control portions respectively positioned on upper and lower sides of the first light control portion, each of which has a reflective surface for reflecting the light from the semiconductor light-emitting element in a predetermined direction.

15. The method according to claim 14, wherein the first light control portion and the second light control portions further diffuse the light from the semiconductor light-emitting element in a vertical direction, and wherein the reflective surface of the third light control portion positioned on the upper side of the first light control portion, and the reflective surface of the third light control portion positioned on the lower side of the first light control portion have different shapes from each other.

16. The method according to claim 13 further comprising: mounting the semiconductor light-emitting element on a power supply member, and mounting the power supply member on a heat sink for dissipating heat generated from the semiconductor light-emitting element.

17. The method according to claim 16, wherein the inner lens includes a positioning portion for positioning the power supply member or the heat sink.

18. The method according to claim 16, wherein the heatsink has a U-shaped vertical cross section.

19. The method according to claim 13 further comprising:

positioning a plurality of the semiconductor light-emitting element adjacent to each other at equal intervals; and arranging a plurality of the inner lens adjacent to each other in the lateral direction so as to respectively correspond to each of the plurality of semiconductor light-emitting elements.

20. The method according to claim 19, wherein the plurality of inner lenses are formed to be one-piece component.

* * * * *